United States Patent [19]

Mayo et al.

[11] 4,293,167

[45] Oct. 6, 1981

[54] ROLLING CUTTER DRILL BIT WITH IMPROVED JOURNAL CONFIGURATION

[75] Inventors: Terry H. Mayo; John D. Parrish, both of Houston, Tex.

[73] Assignee: Reed Tool Company, Houston, Tex.

[21] Appl. No.: 133,221

[22] Filed: Mar. 24, 1980

Related U.S. Application Data

[63] Continuation of Ser. No. 876,969, Feb. 13, 1978.

[51] Int. Cl.[3] ..... F16C 17/12

[52] U.S. Cl. ..... 308/8.2; 175/371

[58] Field of Search ..... 308/8.2, 37, 135, 163, 308/165, 237 R; 175/371, 372

[56] References Cited

U.S. PATENT DOCUMENTS

| | | | |
|---|---|---|---|
| 3,862,762 | 1/1975 | Millsap | 308/8.2 |
| 4,145,094 | 3/1979 | Vezirian | 308/8.2 |
| 4,157,122 | 6/1979 | Morris | 175/371 |
| 4,181,377 | 1/1980 | Oelke | 308/8.2 |

*Primary Examiner*—Lenard A. Footland

*Attorney, Agent, or Firm*—Michael J. Caddell

[57] ABSTRACT

A rolling cutter drill bit is disclosed which utilizes a plurality of rolling cutters each rotatably mounted on a lug member having a downwardly extending bearing journal. Each bearing journal has a ball bearing race formed therein for receiving a series of ball bearings which also seat in a mating ball bearing race formed in the rotatably mounted cutter. The ball bearings are arranged to share the axial loading placed on the rolling cutter and primarily lock the cutter on the journal shaft. Each journal is further provided with a unique large thrust surface across the downward end of the bearing shaft and generally perpendicular to the radial bearing surface. The large flat perpendicular thrust surface eliminates the need for a standard pilot pin structure normally found in rolling cutter bits. The elimination of the pilot pin structure allows the radial bearing surfaces to be machined in a more economic manner and eliminates the accumulated tolerances being concentric bearing surfaces which previously contributed greatly to cocking of the cutter on the journal and the resulting high stress single point loading which occurs from the cocking action of the cutter.

5 Claims, 1 Drawing Figure

ROLLING CUTTER DRILL BIT WITH IMPROVED JOURNAL CONFIGURATION

This is a continuation of application Ser. No. 876,969, filed Feb. 13, 1978, by Terry H. Mayo and John D. Parrish, for "ROLLING CUTTER DRILL BIT WITH IMPROVED JOURNAL CONFIGURATION".

BACKGROUND OF THE INVENTION

This invention generally involves rolling cutter drill bits and more specifically involves an improved journal configuration for rolling cutter drill bits. The present invention, while being advantageous for unsealed roller bearing bits, is also advantageous in sealed roller bearing bits and in sealed and non-sealed friction bearing bits.

During the operation of the prior art drill bits the rolling cutter rotates on a machined journal extending downward from the lug. The journal generally comprises a radial bearing surface which is the main bearing, and a retention or thrust bearing which is a ball bearing. In addition, the journal has a smaller machined section at the lowermost end which is a pilot pin and which also has a secondary radial bearing surface machined thereon preferably concentric with the main radial bearing surface. During operation of the prior art drill bit the rolling cutter rotates on the two radial bearing surfaces described above which surfaces receive the main radial bearing load. The forces attempting to push the rolling cutter upward on the journal or pull the cutter downward from the journal are termed axial or thrust forces and are sometimes shared by the ball bearing, the perpendicular end of the pilot pin, and the annular surface of the end of the main journal, surrounding the pilot pin perpendicular to the radial bearing surfaces. In some bits only the downwardly directed axial forces are loaded on the ball bearings and the upward thrust forces are carried by the two perpendicular surfaces.

Because the concentric surfaces of the main journal section and the pilot pin section both conjointly share the radial bearing load, the surfaces preferably are machined to extremely close tolerances. This requires a very exacting machine operation because of the non-contiguous bearing surfaces on the main journal and the pilot pin. As a result of the failure to machine these two surfaces exactly concentric, which failure must arise through normal machining tolerances, the rolling cutter under various loading conditions will become cocked on the journal. This is because the tolerances between the main radial bearing surface and the pilot pin bearing surface are additive and allow the tilting of the cutter with respect to the surfaces. This tilting results in a single point contact between the bearing surfaces on the journal and the mating surfaces of the bearing and the cutter internal surface. This point loading results in extremely rapid wear from spalling and galling between the journal and the cutter. In order to remove the accumulated tolerances between the parallel surfaces of the main bearing surface and the pilot pin bearing surface, extremely complex and expensive machine operations would be required. Because of the economics involved, these machining operations are not usually performed in the drill bit manufacture.

In addition to the problems encountered with machining the non-contiguous radial bearing surfaces to reduce eccentricities therebetween, there is also a problem with axial thrust bearing surfaces in prior art devices. A majority of the conventional drill bits utilize the perpendicular end of the pilot pin as a thrust load sharing surface. In manufacturing the cutter to receive the pilot pin, a weakened area is formed in the cutter cone by the recess machined into it for the pilot pin. This weakness has resulted in the pin punching through the cone during drilling operations, and has caused loss of the hard cone in the borehole. This requires an expensive trip out of the hole and a fishing operation to clear the ruptured cone from the borehole.

Thus, the standard drill bit manufactured today results in the accumulated tolerances which leads to excessive wear through point loading contact, and weakened cone structure due to the pilot pin construction. The present invention greatly reduces the problem of accumulated tolerances by providing a journal on a drill bit lug which has a single radial bearing surface and a large flat thrust bearing surface on the end of the journal perpendicular to the main radial bearing surface. This eliminates the pilot pin configuration which consequently eliminates the accumulated tolerances between the main radial bearing surface and the pilot pin radial bearing surface. Thus, the present invention greatly reduces the premature and rapid deterioration of the bearing surfaces due to the cocking of the rolling cutter on the journal of the bit lug, and eliminates weakness in the cutter cone from the pilot pin recess in the conventional bit.

DESCRIPTION OF THE PREFERRED EMBODIMENTS

Figure 1:
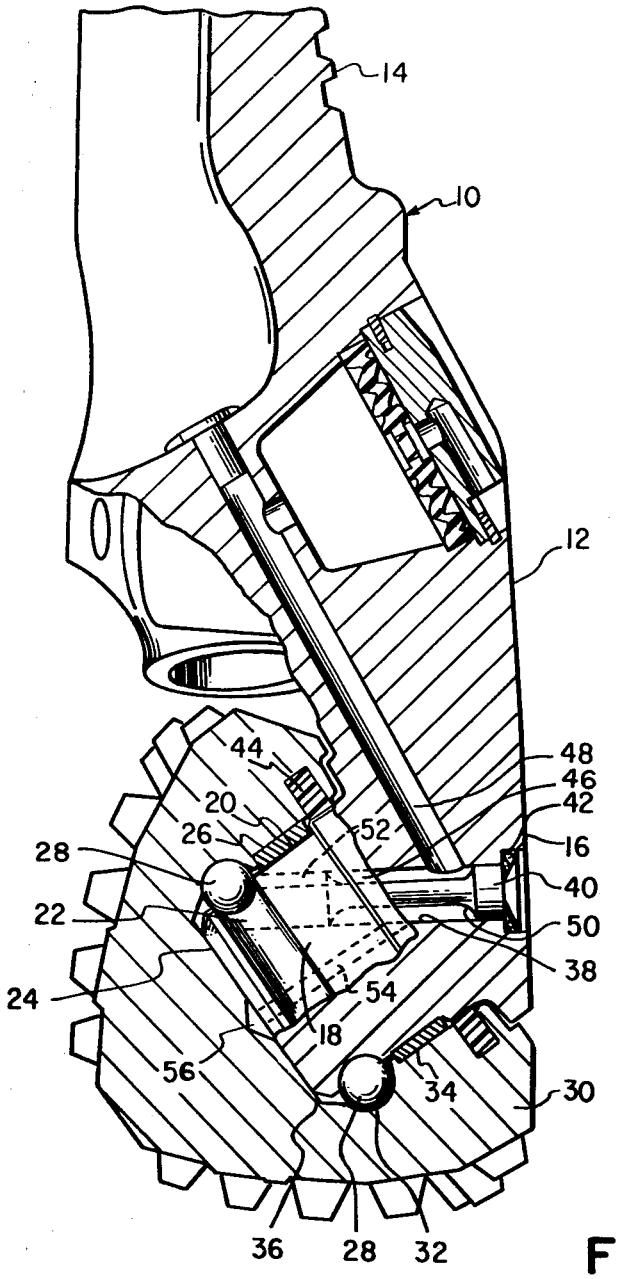
FIG. 1 is a partial cross-sectional side view of a typical bit lug utilizing the novel journal configuration of the present invention.

In FIG. 1 a drill bit lug 10 comprises a main lug 12 and an upper threaded end 14. Normally three of the lugs 12 would be joined by welding of the upper sections of the lugs. A cutter support assembly 16 is formed at the lower end of the lug 12 and has projecting downwardly therefrom a bearing shaft or journal 18. The journal 18 has a main radial bearing surface 20 machined thereon and a roller bearing race 22 machined therein in conjunction with the main radial bearing surface 20. The journal further has at its downward projecting end a large flat thrust surface 24 machined thereon in a plane normal to the main radial bearing surface 20.

A cylindrical friction bearing sleeve 26 is located on the main radial bearing surface 20 in close-fitting relationship thereon. A plurality of spherical ball bearings 28 are located in the ball bearing race 22 and generally serve to retain a conical rolling cutter 30 on the journal 18. A matching peripheral bearing race 32 is formed in the rolling cutter 30 to mate with the ball bearings 28. Likewise, a bearing surface 34 is machined inside the rolling cutter to engage the friction bearing sleeve 26 and rotate thereon.

A thrust bearing surface 36 is formed in the rolling cutter to abut the thrust surface 24 of the journal 18. A bore passage 38 is formed or machined inside journal 18 communicating with ball race 22 for allowing insertion of ball bearings 28 after cutter 30 has been located over the journal in the proper location. A retaining pin 40 is snuggly fitted within bore passage 38 and retains the ball bearings 28 in their bearing race 22. Retaining pin 40 is preferably welded into position in the bore passage 38 by welding to the lug at 42.

A peripheral sealing ring 44 is located in the cutter and arranged to sealingly and rotatably engage a cylindrical smooth sealing surface formed on a raised shoulder 46 near the upper portion of journal 18. Sealing ring 44 may be of the O-ring type or may have a square or rectangular cross section as illustrated. A lubricant channel 48 is formed through the interior of lug 12 and communicates a lubricant source to bore 38 in the annular area 50 undercut on retaining pin 40. A lubricant groove 52 shown in phantom is formed in pin 40 and allows lubricant to communicate from undercut 50 to the retention bearings 28. A second lubricant passage 54 passes through the center of lug journal 18 and communicates lubricant to a cavity 56 whereupon the lubricant is distributed between the thrust surfaces 24 and 36.

Thus, in manufacturing the drill bit of this invention, three lugs 12 are provided, each with a cylindrical journal 18 having a machined friction bearing surface 20 along the major portion of the length thereof. A circular peripheral bearing race 22 is machined in the journal and the perpendicular thrust bearing surface 24 substantially co-extensive in diameter with the lug journal 18 is formed at the end of the journal. A rolling cutter 30 having the usual cutting teeth located externally thereon is slipped over the journal with the cylindrical friction bearing 26 in place and the radial seal member 44 secured therein. After the rolling cutter is located over the journal with the seal and the friction bearing in place, the requisite number of ball bearings 28 are loaded into the bearing race 22 through the passage 38. After the bearings are in place, the rolling cutter is secured on the journal by the action of the ball bearings seating in the mating bearing race 32 formed in the rolling cutter. The retention pin 40 is then placed in passage 38 into abutment with bearings 28 and welded in place. Preferably, pin 40 has a surface at its inward end which matches the surface of bearing race 22 to prevent interference with ball bearings 28.

Thus, it can be seen that with the drill bit construction above described, the novel journal configuration provides a main radial thrust bearing surface 20, a main axial thrust surface 24 and a retention thrust bearing assembly comprising race 22, race 32 and ball bearings 28. The large axial bearing surface 24 provides sufficient bearing surface to withstand the large axial thrust forces incurred during operation of the bit. The elimination of the concentric bearing surfaces between the prior art pilot pin radial bearing surface and the normal main radial bearing surface eliminates the deleterious cocking and premature wear normally occurring in the prior art devices.

The present invention is particularly advantageous in that a single radial bearing surface is all that is required to sustain the radial forces and a single axial surface in conjunction with a retention thrust bearing assembly absorbs the axial and thrust loads. The provision of the large perpendicular thrust surface being substantially as large as the diameter of the radial main bearing surface allows easy and economical machining of the journal to prevent accumulated bearing tolerances with the consequent high stress point loading from cocking of the cutter on the journal. The configuration providing the large thrust surface 24 provides a maximum amount of bearing surface for distributing the thrust loads uniformly, thereby reducing friction and heat.

It should be noted that the preferred embodiment illustrated herein utilizes a friction sleeve bearing as the main radial bearing, and ball bearings as means of retention of the cutter on the shaft. Also, the main thrust bearing disclosed comprises a machined surface on the shaft perpendicular end contacting a similar surface in the cutter. Other types of bearings can be used in place of those disclosed. For instance, roller bearings can be used instead of the friction bearing. Also, mating machined surfaces, heat-treated and hardened, can be used as the radial bearing means rather than insert sleeves or roller bearings. Bearing material can be plated on the journal and/or in the cutter to share the radial and thrust loads; and alloys can be diffused or otherwise impregnated into the journal and cutter surfaces to serve as bearing means. Bearing surfaces can be made by welding hard material onto the bearing areas of the shaft and cutter and machining this down.

Likewise other retention means than ball bearings and bearings races can be used to hold the cutter on the journal shaft. These include snap rings, flanges, pins, and recesses.

Although certain preferred embodiments of the present invention have been herein described in order to provide an understanding of the general principles of the invention, it will be appreciated that various changes and innovations can be effected in the described drill bit structure without departure from these principles. For example, whereas a drill bit utilizing friction bearings and being lubricated and sealed is disclosed, it is clear that other types of drill bits being sealed and non-sealed and utilizing other types of bearings may also incorporate the present invention. Thus, all modifications and changes of this type are deemed to be embraced by the spirit and scope of the invention except as the same may be necessarily limited by the appended claims or reasonable equivalents thereof.

The embodiments of the invention in which an exclusive property or privilege is claimed are defined as follows:

1. A rolling cutter drill bit comprising:

a bit body;

at least one lug extending downward from said body;

each said lug having a journal shaft formed thereon, said shaft extending downward and comprising: a cylindrical radial bearing portion defining the main diameter of said shaft, a single, generally flat, free end on said radial bearing portion covering substantially the entire diameter thereof and being substantially perpendicular thereto, and an axial bearing portion on said free end of said journal shaft, extending across substantially all of said main diameter of said shaft;

a cutter rotatably mounted on each said journal shaft and having formed therein a radial bearing portion arranged to be located over said journal shaft radial bearing portion, and an axial bearing portion arranged for rotatable bearing action with said shaft axial bearing portion;

first bearing means located between and rotatably conjoining said shaft radial bearing portion and said cutter radial bearing portion;

second bearing means arranged for rotatable interaction with said cutter axial bearing portion and said shaft axial bearing portion; and, retention means between said cutter and said journal shaft arranged to retain said cutter on said shaft.

2. The drill bit of claim 1 wherein said retention means comprises ball bearing means.

3. The drill bit of claim 1 wherein said first bearing means comprises a cylindrical friction bearing sleeve adapted for close-fitting, surface contact between said shaft and cutter radial bearing portions.

4. The drill bit of claim 1 wherein said second bearing means comprises bearing surfaces formed on said cutter and shaft axial bearing portions.

5. In a rolling cutter drill bit having at least one downwardly extending lug with a rolling cutter rotatably mounted on a bearing shaft extending from each said lug, the improvement comprising:

each said bearing shaft having a generally cylindrical radial bearing surface defining the diameter of said shaft, and a free end across said diameter; and, a single substantially flat, axial bearing surface formed on said free end, generally normal to said radial bearing surface, and covering substantially all of said free end.

* * * * *